US011578934B1

(12) United States Patent
Pachelli et al.

(10) Patent No.: US 11,578,934 B1
(45) Date of Patent: Feb. 14, 2023

(54) LIGHTWEIGHT MACHINE GUN RECEIVER AND METHOD OF MANUFACTURING

(71) Applicants: Michael Pachelli, Fort Lauderdale, FL (US); Bryan M. Florescue, Pompano Beach, FL (US)

(72) Inventors: Michael Pachelli, Fort Lauderdale, FL (US); Bryan M. Florescue, Pompano Beach, FL (US)

(73) Assignee: TECHNOLOGY AND LOGISTICS, INC., Fort Lauderdale, FL (US)

( * ) Notice: Subject to any disclaimer, the term of this patent is extended or adjusted under 35 U.S.C. 154(b) by 122 days.

(21) Appl. No.: 17/029,301

(22) Filed: Sep. 23, 2020

(51) Int. Cl.
*F41A 3/66* (2006.01)

(52) U.S. Cl.
CPC ..... *F41A 3/66* (2013.01)

(58) Field of Classification Search
CPC ..... F41A 3/66
USPC ..... 89/9, 125
See application file for complete search history.

(56) References Cited

U.S. PATENT DOCUMENTS 11,204,211 B2 * 12/2021 Tabb ..... F41A 3/66

* cited by examiner

*Primary Examiner* — Reginald S Tillman, Jr.
(74) *Attorney, Agent, or Firm* — Malin Haley DiMaggio & Bowen, P.A.

(57) ABSTRACT

A receiver for use in the manufacture of a lightweight and strong machine-gun comprising a left shell that includes a milled, single-piece metal flat body of a predefined peripheral shape that is substantially rectangular, and a right shell including a milled, single-piece metal flat body, including said right shell formed in size and shape to be joined together symmetrically with said left shell, to form a compartment, said left shell and said right shell including the same size and shape dovetail interlocking joints, milled in said left shell and said right shell at the same locations, said left shell joined to said right shell solely by dovetail fasteners, without welding, without rivets, and without nuts and bolts, forming a rigid, strong, lightweight machine-gun receiver. First and second takedown pins are also used to fasten the left shell to the right shell after the left and right shells have been interlocked together by the dovetail interlocking joints to prevent vertical movement between the left shell and the right shell.

11 Claims, 13 Drawing Sheets

10

LIGHTWEIGHT MACHINE GUN RECEIVER AND METHOD OF MANUFACTURING

BACKGROUND OF THE INVENTION

1. Field of the Invention

A lightweight machine-gun receiver and the method of manufacturing comprising a machine-gun left shell, constructed from an elongated, milled, flat single-piece of metal, and a machine gun right shell, constructed from an elongated, milled, single-piece of metal, said left shell having a plurality of dovetail interlocking joints, said right shell having a plurality of complementary dovetail interlocking joints, said left shell and said right shell firmly fastened together by said left shell and said right shell dovetail interlocking joints, eliminating welding and rivets, providing an exceptionally strong, very lightweight machine-gun receiver.

2. Description of Related Art

Traditional belt-fed machine guns have been manufactured from inexpensive carbon steel. A typical machine-gun includes a plurality of individual parts that make up the receiver. The machine-gun receiver parts are fastened together by rivets and welding, resulting in a very heavy, expensive to manufacture and assemble, machine-gun.

An example of a traditional machine-gun would be the model M 240. Because of its extreme weight, the M 240 firearm was and is often carried with difficulty by the war fighter. The M 240 machine-gun length is relatively long and cumbersome for implementation on a battlefield as an assault weapon. The M 240 receiver chamber may include up to 19 separate metal elements, affixed into the receiver chamber.

The manufacture of a machine-gun receiver with numerous individual, different parts increases the overall cost of manufacturing, and the weight of the receiver itself.

The improved lightweight machine-gun and method of manufacture described herein, and in particular, the improved receiver and its manufacture, can reduce by as much as one-third the length of a conventional light infantry machine-gun, such as the M 240, and can reduce the weight of the overall machine-gun by as much as one third. This greatly improves the war fighter portability and manipulation of a light machine-gun, increasing fire capability as well as reliability.

The improved invention described herein discloses a weapon receiver, formed from a left shell and a right shell, each shell milled from a single sheet of metal, to integrate up to 19 separate metal elements within the receiver chamber, Also, in the invention described herein, forming the left shell and the right shell, each shell from a milled, flat, single-piece of metal, allows the left shell and right shell wall structures to be varied, in thickness at strategic locations, to permit reductions in the overall weight of each shell, while at the same time increasing each shell's overall strength, without diminishing the firing action of the machine-gun in any way.

Published firearm disclosures describe guns, both toy and real, typically as having left and right frames, left and right housings, and left and right shells, that all use rivets and welding for joining and connecting these left and right gun components, forming firearm receivers.

Applicants have found that the strongest and best way to firmly connect the left shell and the right shell together, especially in manufacturing a lightweight machine-gun that has a superior housing to withstand the forces required in the operational machine-gun, are best constructed using an elongated, flat, milled single-piece of metal for each shell, each shell (left and right) constructed having inside receiver surfaces and portions of its perimeter milled with a plurality of dovetail inter-lockable joints, for rigidly connecting the left shell and the right shell together in the construction of a machine-gun, greatly reducing weight and length of the machine-gun and cost of manufacturing, while increasing efficiency in the manufacturing process.

SUMMARY OF THE INVENTION

A receiver for a firearm comprising a left shell and a right shell, each formed from an elongated, substantially flat, milled, single-piece of metal. The left shell and the right shell are firmly connected together by a plurality of dovetail inter-lockable joints, located at strategic corresponding locations on the left shell and the right shell.

The left shell and the right shell, each include an elongated, substantially flat, plate receiver inside wall surface, and a unitary bottom horizontal wall. The left shell and the right shell each have upper and lower horizontal dovetail interlocking joints, protruding perpendicularly inwardly from the left shell receiver inside wall surface and the right shell receiver inside wall surface. The left and right shell dovetail interlocking joints provide a vertical joint connection together. A dovetail joint is formed by one or more tapered projections (tenons) on one piece which interlock with corresponding notches or recesses (mortises) in another piece. The dovetail tenons and mortises are sized for mutual engagement with each other, for firmly connecting the left shell to the right shell with the dovetail interlocking joints, eliminating the need for joining the left shell to the right shell with rivets, welding, or fastening bolts and nuts. A pair of takedown pins are used to connect the right shell and the left shell together, to prevent vertical movement or separation of the left shell relative to the right shell within the dovetail interlocking joints.

The two-piece receiver is formed by joining the left shell and the right shell together to form a chamber by manually engaging the dovetail interlocking joints on the left shell with the corresponding ones on the right shell. Each shell is made of a flat, single, rectangular plate of metal. The left shell and the right shell have outside receiver surfaces and inside receiver surfaces. The inside receiver surface of each shell has a plurality of milled machine projections at precise locations that, when the left and right shells are joined, act as a receiver and function to engage essential components of the machine-gun that are housed inside the receiver chamber, including the bolt and operating rod assemblies, and attached or connected to the receiver including a threaded barrel assembly, a trigger assembly, and a butt stock. The inside receiver surface of the left shell has a similar, but not identical, array of milled protrusions that function with similar milled protrusion operating elements on the inside receiver surface of the right shell. The inside surface protrusions for the left and right shells are precision machined during manufacturing for maximum cooperation with the corresponding protruding elements for the essential proper connection of the threaded barrel assembly to a threaded barrel assembly locking interface and housing of the gas tube assembly that also include dovetail interlocking joints to connect the left shell in the right shell. The shape and function of the left shell milled protruding inwardly elements are not identical to the construction of the right shell milled protruding inwardly elements, but are designed to complement each other and securely connect the threaded barrel assembly and house the gas tube assembly when the left shell is physically connected to the right shell, as well as guide the action of the bolt and operating rod assemblies. For example, left shell right shell each have milled inwardly protruding elements to form the threaded barrel assembly locking interface, when joined that connects a threaded barrel assembly to the receiver.

The dovetail interlocking joints that connect together the left shell and the right shell, provide excellent tensile strength for holding the left and right shells together, withstanding the shearing forces on the overall receiver when the machine-gun is fired or subjected to other external forces. A dovetail joint includes tapered projections (tenons) on one piece that interlock with corresponding notches (recesses or mortises) on another dovetail joint piece, to form a very strong interlock. Each tapered dovetail tenon is typically wider at its extremity than at its base.

One definition of a dovetail joint includes a flaring tenon and mortise into which it fits tightly, making an interlock joint that resists pulling apart in all directions except one.

Several different top and bottom left shell and right shell peripheral and receiver inside horizontally inwardly facing areas, can be formed and milled. The dovetail joints interlock the left shell and the right shell by manual vertical movement and connection of the left shell with the right shell at precise corresponding locations, so that the left shell can be firmly joined to the right shell in a plurality of dovetail interlocking joints. The peripheral areas with the dovetail to locking joint facing inwardly on the left shell and the right shell preferably will be along the top surface of each shell and in designated areas of the bottom surface of each shell.

In the construction of a machine-gun using the invention, the left shell and the right shell are milled individually with the appropriate number of corresponding related dovetail joints at predesignated corresponding inside surface protrusions and peripheral locations. Once formed, the left shell and the right shell are then connected together, initially to form the machine-gun receiver, before any components, such as the operating rod assembly, bolt assembly, and the gas tube of the machine-gun, are housed in the chamber formed by the left and right shells.

The machine-gun components necessary to be housed in the receiver chamber include the threaded barrel assembly, securely connected in front to the milled threaded barrel assembly locking interface, the gas tube assembly, the bolt assembly, and operating rod assembly. The buttstock is removably attached to the rear end face of the receiver.

A detailed description of a complete machine-gun is not required to fully disclose the present invention. The machine-gun receiver, described herein, is sufficient as described to be used to manufacture an improved lighter weight, stronger machine-gun, having less individual parts, at a greatly reduced expense. The firearm receiver described herein is capable of housing, securely connecting or and guiding the action of attaching all of the necessary, essential components of a machine-gun such as a M 240 MC, using existing off-the-shelf machine-gun components that include the threaded barrel assembly, bolt assembly, the operating rod assembly, and exhaust tube, housed in the front forward end of the receiver described herein, once the left shell and right shell have been interlock together by dovetail joints. The receiver described herein also includes a rear, vertical section that includes connectors to attach the buttstock plate removably to the end of the receiver. The receiver is sized and constructed to receive a conventional trigger assembly for a machine-gun. The receiver includes sized and shaped openings of the proper chamber areas to receive mechanisms that provide for the feeding and ejection of ammunition in a high-speed manner.

Advantages of milling left and right receiver shells include having an integrated rear site formed on the receiver top with the receiver dovetail connectors; ambidextrous charging handle slots, left and right sides, for the ambidextrous use of the charging handle on either side of the receiver; and a threaded barrel assembly locking interface, provided by the left shell and the right shell together, for housing a threaded barrel assembly. The receiver also includes left and right jam studs, one positioned on each side of the outside surface of the left shell and the right shell for a warrior pivoting the weapon at a vertical edge opening.

Another advantage of milling left and right receiver shells is the formation of integrated milled guide rails, substantially horizontal, on the inside receiver shell surfaces to guide the action of internal moving assemblies in the receiver. This reduces the manufacturing complexity of individual parts that must be fastened in position inside the receiver to the left and right shells, reduces weight, and reduces costs of production.

It is an object of this invention to provide a machine-gun receiver that houses certain machine-gun components resulting in an improved light weight machine-gun that can be safely and effectively manipulated by a single warrior. The light weight machine-gun is made possible using a lightweight receiver made up of a milled, single-piece metal left shell and a milled, single-piece metal right shell, firmly interlocked together in critical areas by a plurality of dovetail joints, at strategic locations on the left shell and the right shell.

BRIEF DESCRIPTION OF THE SEVERAL VIEWS OF THE INVENTION

DETAILED DESCRIPTION OF THE INVENTION

Figure 1:
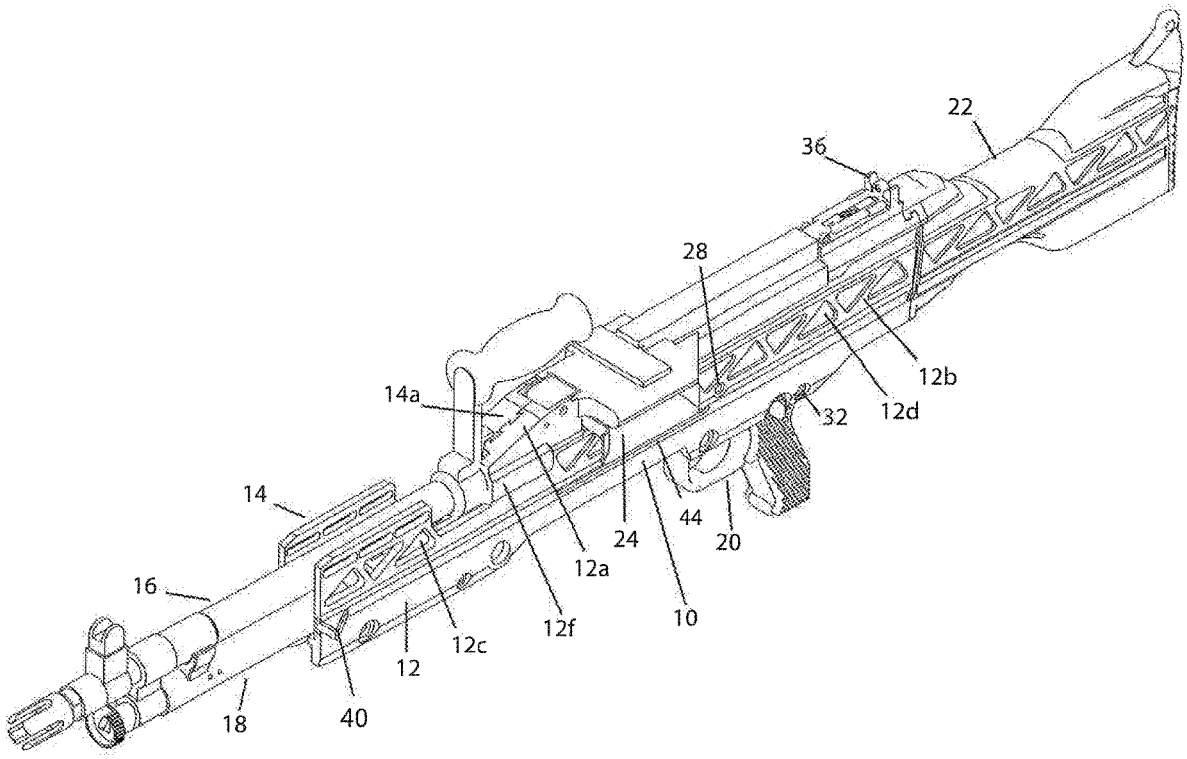
FIG. 1 shows a perspective upper view of a representative machine-gun that includes a receiver constructed in accordance with the invention.

Referring now to the drawings, specifically FIG. 1, a representative machine-gun made in accordance with the present invention, is shown including a receiver 10 that includes left receiver shell 12 interlocked to right receiver shell 14 by a plurality of dovetail interlocking joints 12*a* on the milled top periphery (a section of the integrated, self-contained threaded barrel assembly locking interface housing) of left shell 12 joined to dovetail interlocking joints 14*a* on the milled top periphery (a section of the integrated, self-contained threaded barrel assembly locking interface housing) of the right shell 14.

The machine-gun shown in FIG. 1 includes a threaded barrel assembly 16 (that is securely connected to a threaded barrel assembly locking interface 12*f* in receiver 10 at and below the dovetail interlocking joints 12*a* and 14*a*), a gas tube 18, also housed in the chamber formed by receiver 10, a pistol/trigger assembly 20 attached to the bottom of receiver 10, and a buttstock 22 attached to the rear end of receiver 10. The machine-gun also includes a belt opening 24 that receives bands of ammunition.

FIG. 1 shows a rear gun sight 36, formed by joining the left shell 12 to the right shell 14 with dovetail joints. Also shown in FIG. 1 is a jam stud 40 protruding outwardly from the exterior surface of left shell 12. A similar jam stud is located on right shell 14. The jam studs are designed to position the weapon, pressed against a vertical edge surface, to hold the weapon firmly in place, allowing the warrior to pivot the weapon.

The machine-gun shown in FIG. 1 is very lightweight and reduced in length compared to a conventional M 240 machine-gun. The receiver 10 however, as shown interlocked by a plurality of dovetails joints without any welding can be used across platforms to other machine gun weapons systems.

The left shell 12 and the right shell 14 also include various rib portions 12*b* that are thicker than the panel 12*d* next to the rib portions 12*b*, to reduce weight and increase the strength of the left shell 12. The left shell also includes areas of open passages or apertures 12*c* that allow the threaded barrel assembly 16 to cool so that air can flow through passages 12*c* for cooling.

The machine-gun, shown in FIG. 1, includes the invention and has a plurality of dovetail interlocking joints, many of which are described below.

Figure 2:
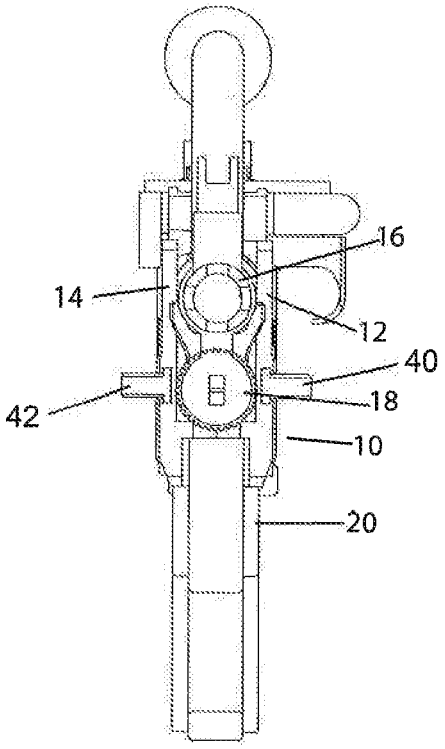
FIG. 2 shows a front elevational view of the machine-gun shown in FIG. 1.

FIG. 2 shows a front elevational view of the machine-gun shown in FIG. 1. Also shown in FIG. 2 is left shell 12 and right shell 14 interlocked together forming receiver 10. The trigger housing assembly 20 is also shown as is threaded barrel assembly 16 and gas tube 18. FIG. 2 also shows jam stud 40 and jam stud 42 mounted near the front of the weapon receiver. Slot 44 shows the ambidextrous charging handle slot available in the left shell of the receiver. A similar charging handle slot is provided on the opposite side of the weapon in the right shell, allowing for ambidextrous positioning of the charging handle.

Figure 3:
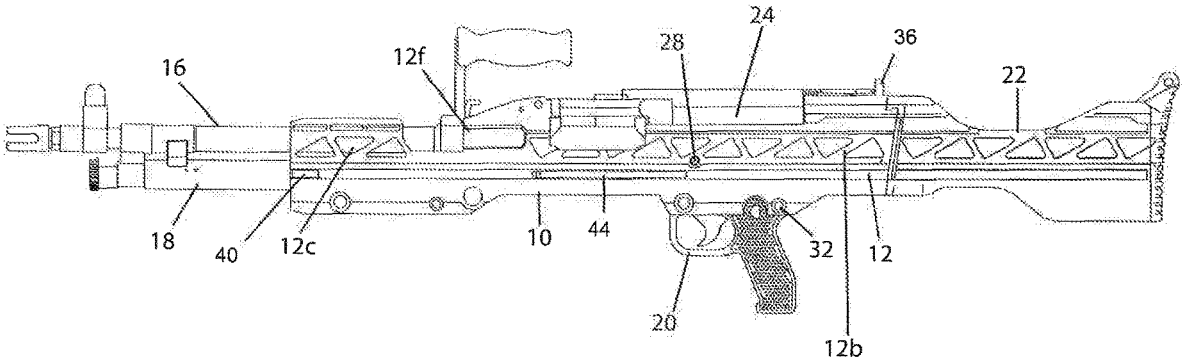
FIG. 3 shows a left side elevational view of the machine-gun shown in FIG. 1.

FIG. 3 shows a left elevational view of a machine-gun that includes the receiver 10 and left shell 12. The threaded barrel assembly 16 is securely connected in milled protruding elements formed on the inside surfaces of left shell 12 shown and right shell 14 joined thereto, that allows the threaded barrel to be securely connected in the receiver 10. The gas tube assembly 18 is also housed in receiver 10 firmly. FIG. 3 shows a trigger housing assembly 20 connected to the receiver 10. The buttstock 22 is also removably attached to the rear end face of the receiver 10. A feed tray assembly 24 is mounted at the top portion of receiver 10 and serves as a guide for positioning cartridges to assist in chambering. FIG. 3 illustrates the rear gun sight 36 and jam stud 40. Aperture 28 and aperture 32 receive takeaway pins shown in FIGS. 13A and 13B to secure the receiver.

Figure 4:
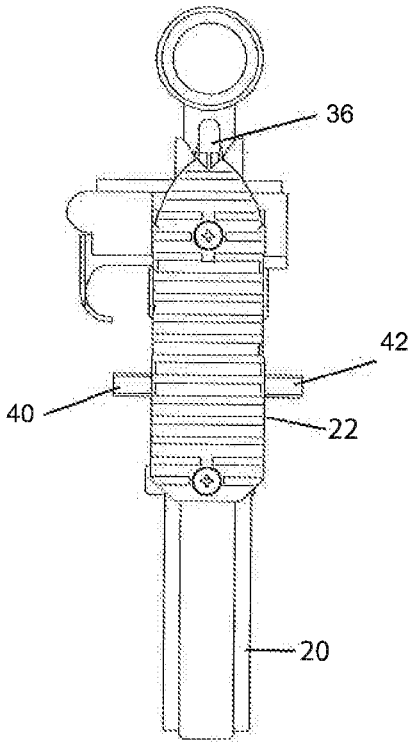
FIG. 4 shows a rear elevational view of the machine-gun shown in FIG. 1.

FIG. 4 shows a rear elevational view including buttstock 22 and trigger housing assembly 20. Also shown are the rear gun sight 36, jam stud 40, and jam stud 42.

Figure 5:
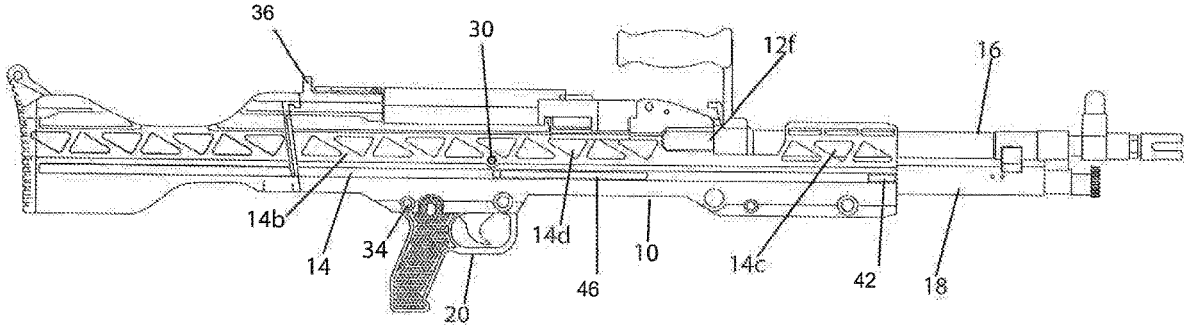
FIG. 5 shows a right elevational view of the machine-gun shown in FIG. 1.

FIG. 5 shows a right side elevational view of the machine-gun shown in FIG. 1. Receiver 10 includes right shell 14 that is very similar in an exterior appearance to left shell 12 (not shown). For example, right shell 14 includes exterior surface areas 14*d* that are not as thick as ribs 14*b* that are thicker than surface areas 14*b*. An open aperture or hole 14*c* allows air and heat to pass through from barrel 16 for cooling. The thickness of right shell 14 varies as a plurality of ribs 14*b* that are thicker than the surface areas 14*b* and are specifically designed to strengthen the entire shell 10, while at the same time reducing weight throughout the shell 10, to make the machine-gun lighter in weight, without sacrificing strength.

FIG. 5 discloses elongated slot 46 which is provided for using a charging handle on the right side of the weapon, making a similar elongated slot 44 on the left side of the weapon ambidextrous for the use of a charging handle, on either side of the weapon. The rear gun sight 36 and the front gun sight 38 are shown. A jam stud 42 is shown mounted at the front end of right shell 14.

Figure 6:
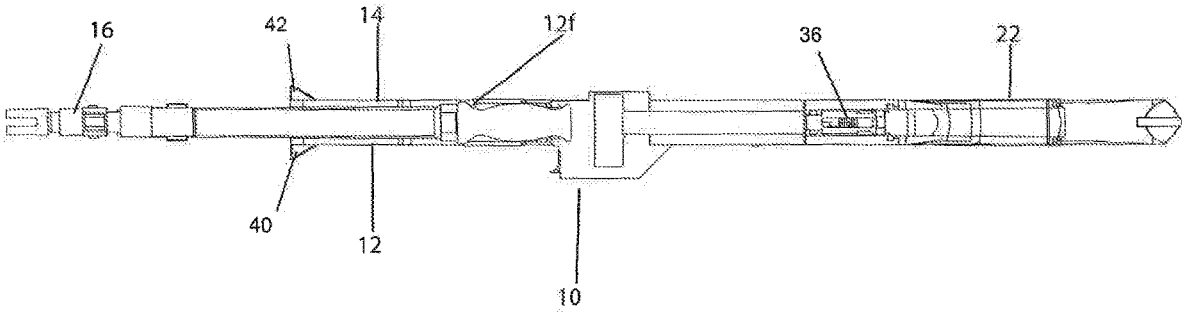
FIG. 6 shows a top plan view of the machine-gun shown in FIG. 1.

FIG. 6 shows a top plan view of the machine-gun shown in FIG. 1. Receiver 10 is formed by left shell 12 and right shell 14. The threaded barrel assembly 16 is housed in threaded barrel assembly locking interface in receiver 10. The buttstock 22 is removably attached to the rear end face of receiver 10. Rear gun sight 36, jam stud 40, and jam stud 42 are shown.

Figure 7:
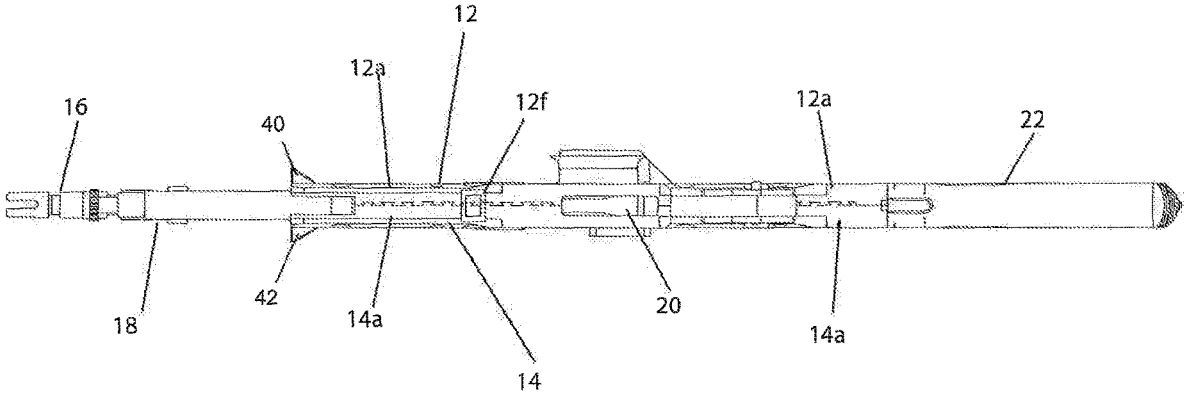
FIG. 7 shows a bottom plan view of a machine-gun shown in FIG. 1 including a plurality of dovetail interlocking joints in accordance with the invention.

FIG. 7 is a bottom plan view the machine-gun shown in FIG. 1. The receiver 10 is shown including left shell 12 and right shell 14 firmly interlocked together by a plurality of dovetail joints 12*a* and 14*a* along the bottom peripheries of left shell 12 and right shell 14. In the receiver 10 shown in FIG. 7, there are no welds connecting the right shell 12 to left shell 14, only dovetail interlocking joints shown at 12*a* and 14*a*. A gas tube assembly 18 is housed in receiver 10 and a threaded barrel assembly 16 securely connected. The buttstock 22 is attached to the rear of receiver 10.

Figure 8:
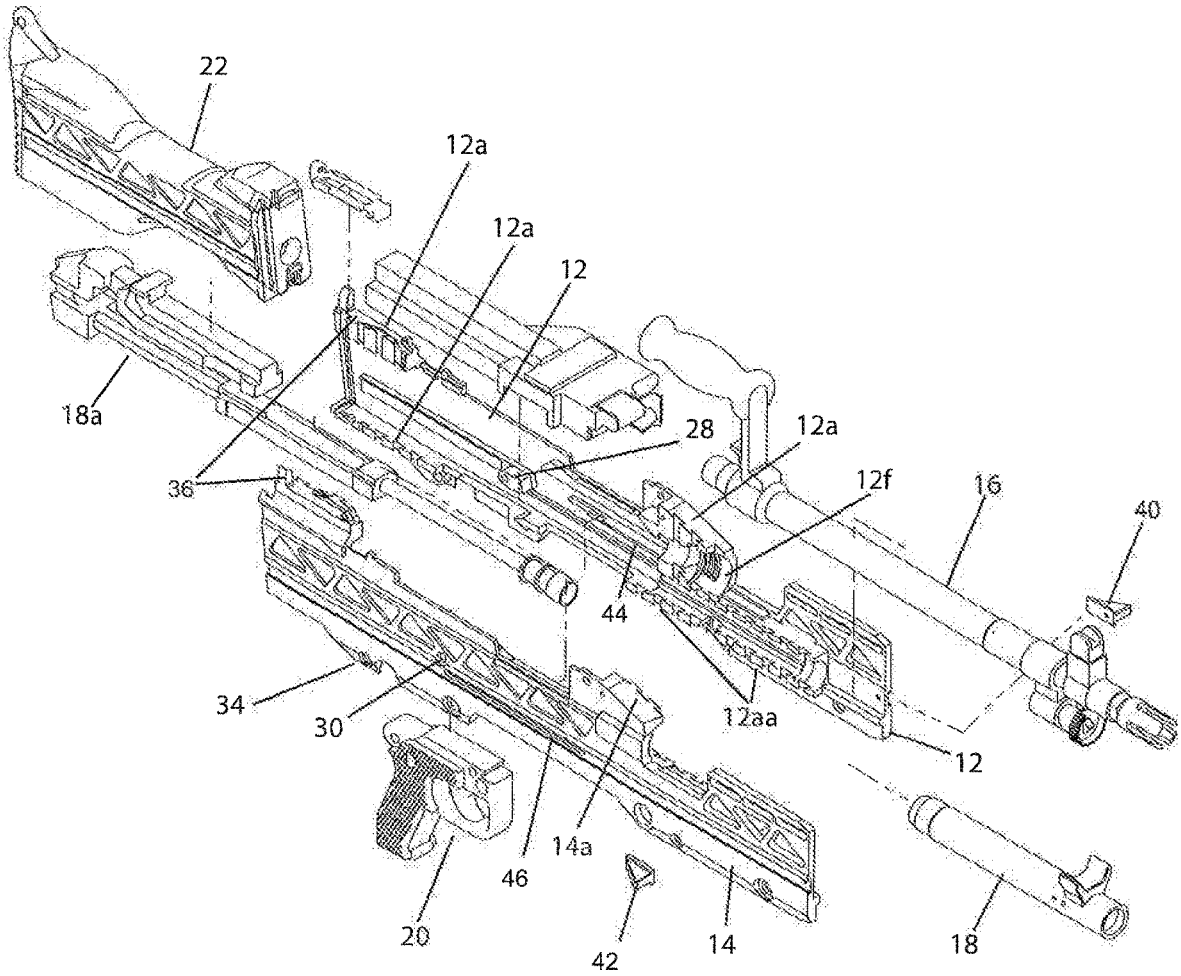
FIG. 8 shows a perspective, upper, right side, exploded view of the machine-gun shown in FIG. 1 including the left shell and right shell separated apart, along with other components separated apart.

FIG. 8 shows an exploded right perspective view of the machine-gun shown in FIG. 1. The left shell 12 is shown separated from the right shell 14 in the exploded view. The inside surface of left shell 12 exhibits a plurality of dovetail joints 12*a* distributed along areas of the top and bottom peripheries of left shell 12 and some in an upper portion on the inside of left shell 12, and dovetail joints at the very top of left shell 12, around a protruding half-curved milled segment that connects the threaded barrel assembly 16 to the receiver 10 having a self-contained threaded barrel locking receptor 12*f* for barrel 16 to properly seat into place and lock down securely, when assembled. The gas tube 18 is housed within the receiver 10 formed by joining left shell 12 to right shell 14 protruding half curved milled segments that also include dovetail joints 12*aa* described herein. The buttstock 22 is connected to the rear portion of the receiver 10 formed by left shell 12 and right shell 14.

The importance of FIG. 8 is to show that the receiver 10 that is formed by left shell 12 and right shell 14 have milled, projecting internal elements that house and lock securely the threaded barrel assembly 16 to the threaded barrel assembly locking interface 12*f* left shell segment when joined to the right shell and the gas tube 18, without any welding or bolts and nuts or rivets. The receiver 10 having a left shell 12, milled from a single-piece of metal, and a right shell 14, milled from a single-piece of metal, together can form a machine-gun receiver 10, shown in FIG. 1, housing, securing, and guiding essential components, including the barrel assembly 16 and gas tube 18 and bolt and operating rod assembly 18*a*, and also attach the trigger assembly 20 and buttstock 22. The assemblage of all the critical components of the machine-gun is accomplished by using a plurality of upper, lower, and middle dovetail interlocking joints, 12*a*, 12*aa*, and 14*a* forming the invention. The left shell 12 interior wall shows integrated guide rails and channels that can guide the action of internal moving assemblies.

Figure 9:
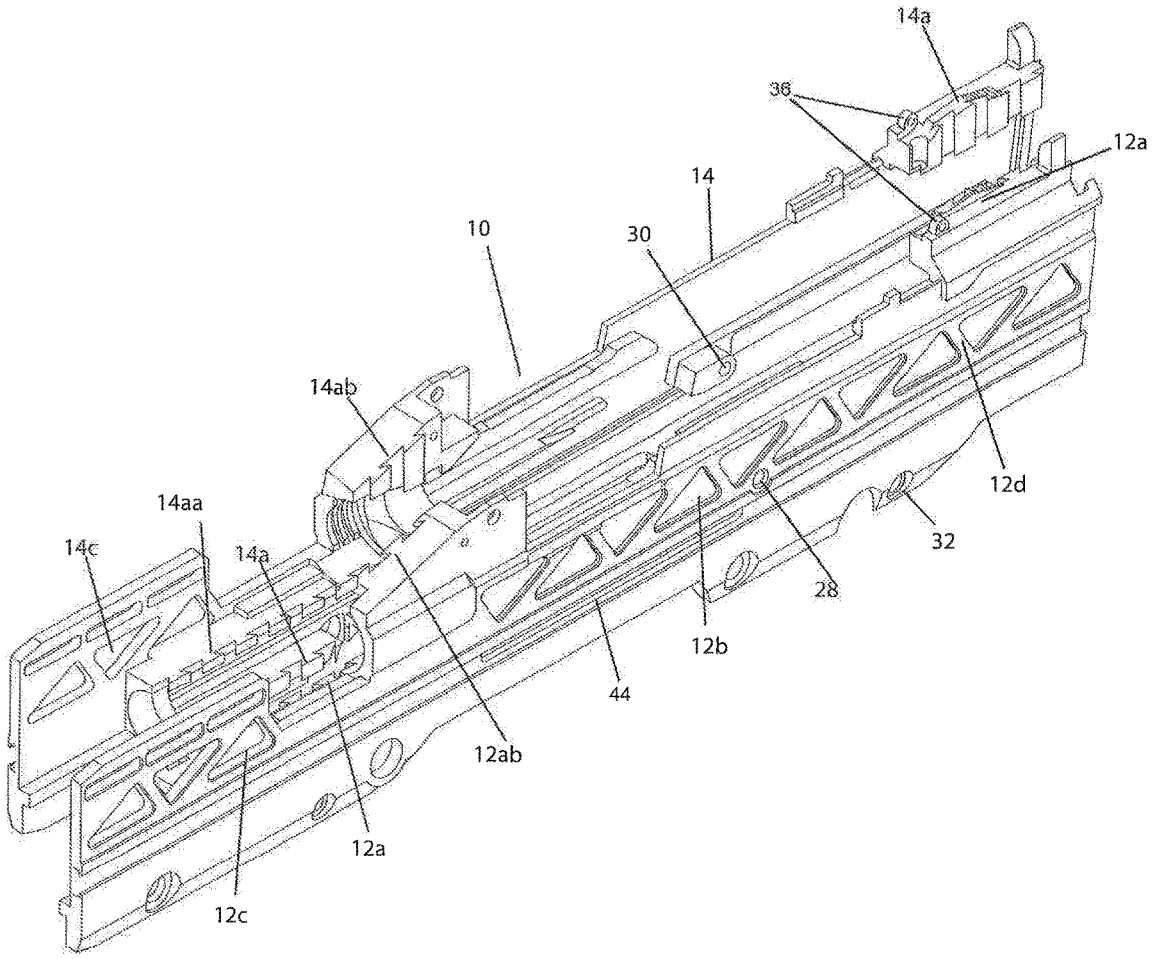
FIG. 9 shows a left side perspective view of the left shell, separated but parallel to, the right shell of the machine-gun shown in FIG. 1.
Figure 10:
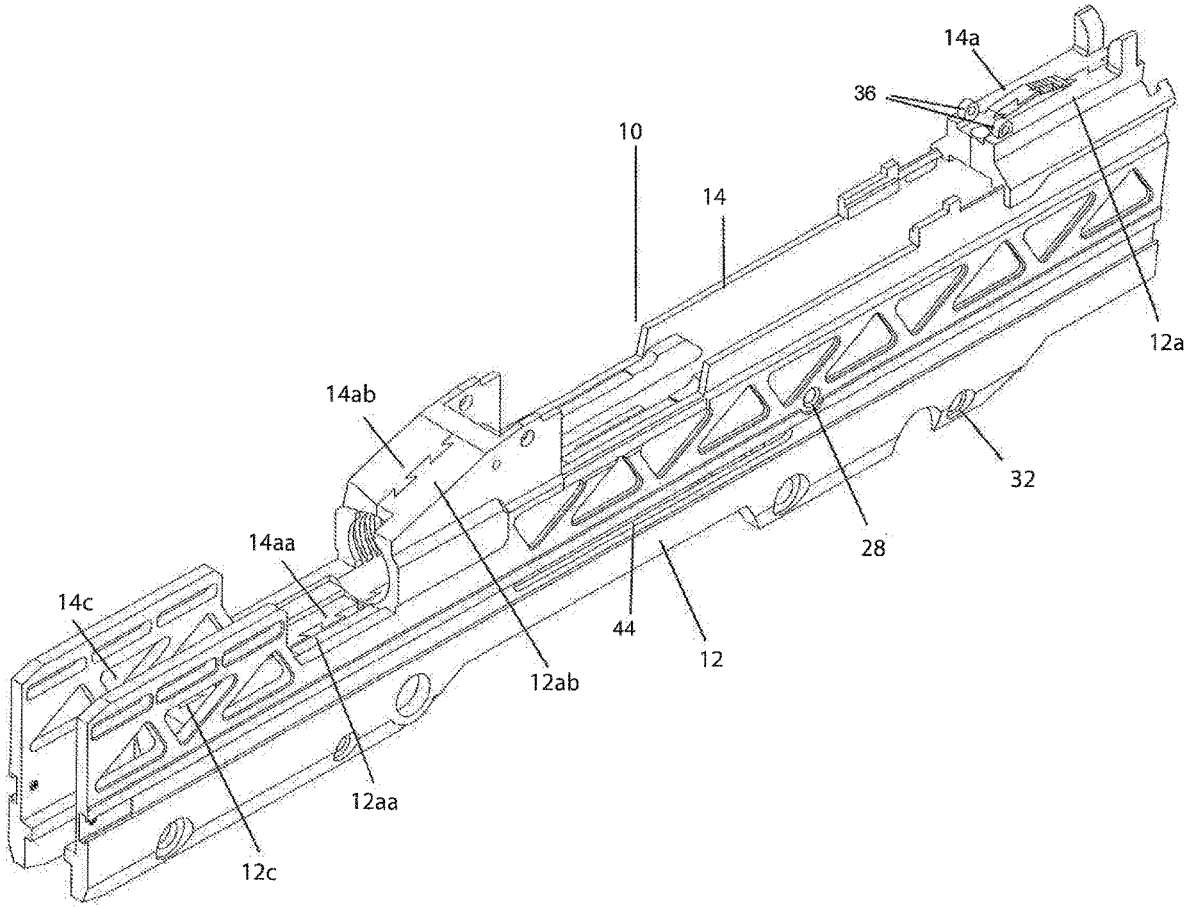
FIG. 10 shows the left side perspective view of the receiver of the machine-gun shown in FIG. 1.

FIG. 9 and FIG. 10 show perspective views of the machine-gun receiver 10. Takeaway pin aperture's 28, 30, 32 are also shown.

FIG. 9 shows a perspective exploded view of the receiver 10 having the left shell 12 separated from the right shell 14. The right shell 14 has a plurality of dovetail interlocking joints 14*a* distributed along the upper periphery of the right shell 14 near the rear of the receiver 10 and a midportion of the receiver 10. Additionally dovetail interlocking joints are shown on the forward bottom periphery of the right shell 14. On the inside surface of the left shell 12, there are a plurality of dovetail interlocking joints corresponding exactly with the dovetail joints 14*aa* shown on the inside surface of the right shell 14, such that the dovetail joints are sized and positioned to allow the left shell 12 to be firmly and completely connected to the right shell 14, eliminating welding, riveting, and bolting together to form a receiver 10 for a machine-gun as shown in FIG. 1. Note that the right shell 14 includes, on its inside surface, protruding, a milled semi-curved segment that houses the gas tube (not shown) and includes dovetail joints 14*aa*, that are interlocked with a series of corresponding dovetail joints to house a gas tube; milled and protruding from the inside surface wall of the left shell 12. Also the right shell 14 includes an upper half element that includes dovetail joints 14*ab* that connect the threaded barrel assembly 16 to the machine-gun when interlocked to the right shell 12 upper barrel receiving element that has dovetail joint fasteners 12*ab* that allow the entire receiver 10 to be firmly interlocked together by the numerous dovetail joint s described herein. The threaded barrel assembly 16 is connected to, and the gas tube assembly 18 and operating rod 18*a* are housed in the receiver 10 by a plurality of inside shell wall surface areas, milled out of single-piece of metal, forming left shell 12 and right shell 14, making the manufacture of the receiver 10 extremely efficient. With respect to automation on different models of machine guns using a receiver similar to receiver 10, formed in the invention, manufacture will require different inside wall protruding-shaped surfaces on each left shell 12 and right shell 14 in order to connect, house, and guide the components of the machine-gun such as the barrel, operating rod, and gas tube assemblies into the receiver 10.

FIG. 10 shows the machine-gun receiver 10. The left shell 12 is firmly interlocked to the right shell 14 exclusively by a plurality of dovetail interlocking joints 14*a*, 14*aa*, and 14*ab* engaged with dovetail joints 12*a*, 12*aa*, and 12*ab*. The receiver 10 is constructed without any welds, any rivets, or any nuts and bolts fastened together. The left shell 12 is formed from a single piece of metal, that is milled, which can be accomplished using computer-aided machining, that can operate 24 hours a day. Likewise, the right shell 14 is milled from a single piece of metal that can be formed using a computer-aided machining factory system run 24 hours a day, with minimal human intervention, greatly reducing the cost of manufacturing, construction and production, as well as, reducing the weight of the final machine gun receiver 10. Also milled outer areas 12*b* are thinner than the rib portions 12*d* at strategic locations, for reductions in weight to the overall receiver 10, as well as engineered against shearing and other forces.

Figure 11:
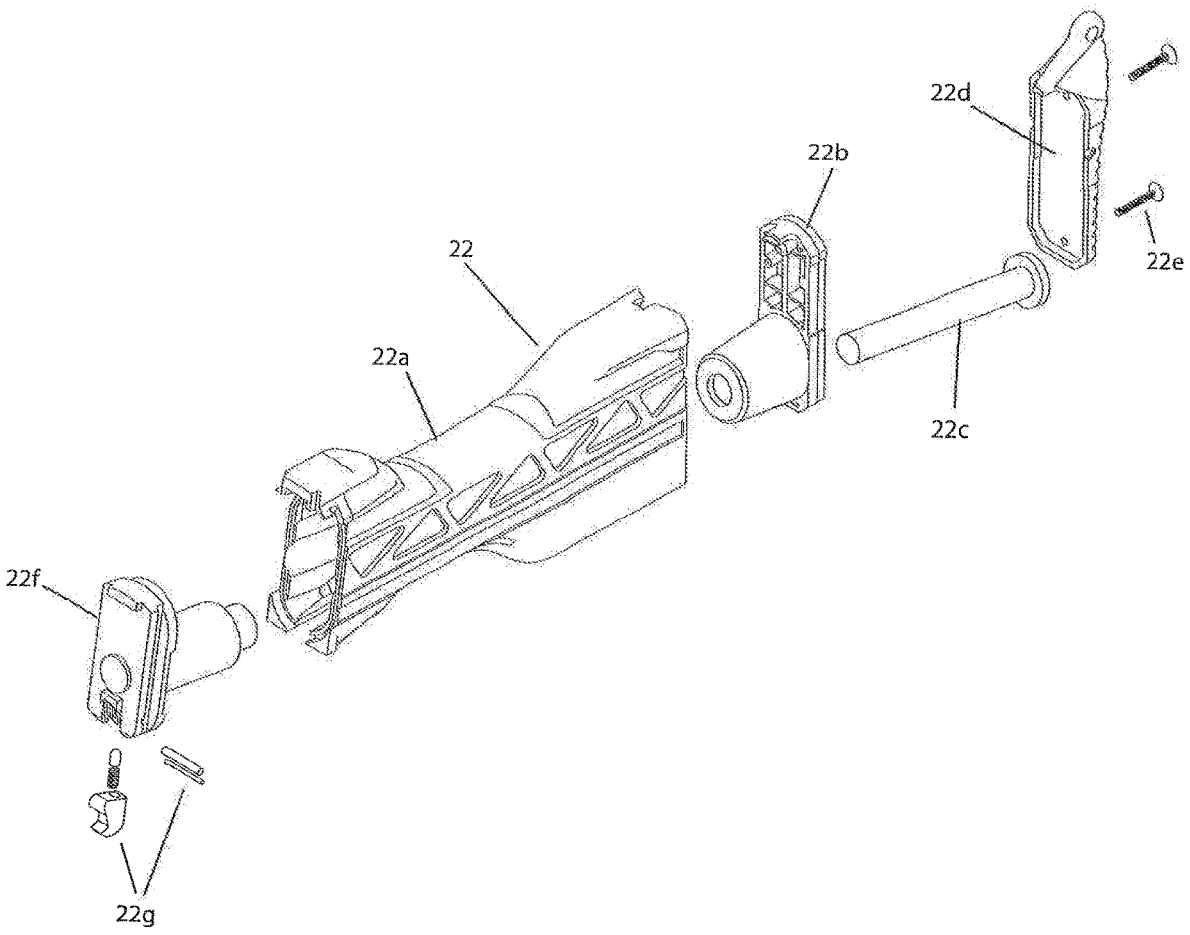
FIG. 11 shows a perspective exploded view of the buttstock of the machine-gun shown in FIG. 1.

FIG. 11 shows an exploded view in a left perspective view of a buttstock 22 that can be removably attached to the receiver 10 shown in FIGS. 1 through 10 above. The buttstock fastener 22*f* includes fastening elements 22*g* that allow the buttstock to be removably attached to the rear end of the receiver 10. The main stock 22 of buttstock 22 is shown that has a hollow interior portion to receive the buttstock fastener 22*f* at one end. A shock of force absorbing element 22*b* fits at the other end with attaching bolt 22*c* for holding the force absorber 22*b* to the main stock portion 22*a*. A shoulder engaging pad 22*d* is fixed to the shock absorbing plate 22*b* by fasteners 22*e*. The buttstock 22 provides comfortable, firm extension when attached to the machine-gun receiver 10 for absorbing the shock of firing the machine-gun against one's shoulder. The buttstock 22 is also lightweight but extremely strong and can be detached from the machine-gun via the receiver 10.

Figure 12:
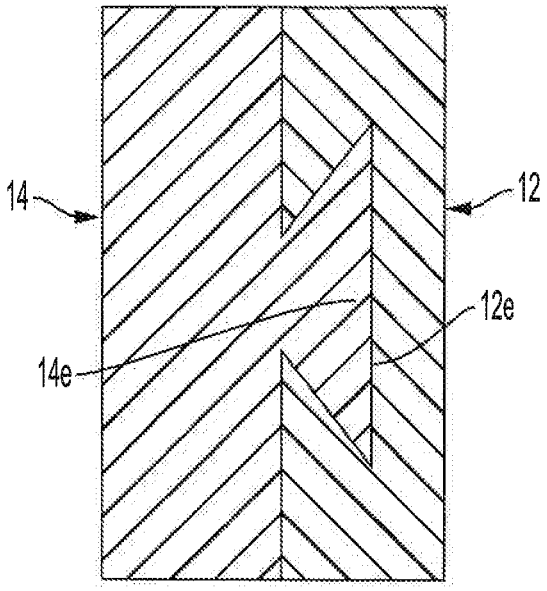
FIG. 12 shows a schematic drawing of a dovetail joint in cross-section.

FIG. 12 shows an example of a dovetail joint formed with shell 12 and shell 14 that can be utilized in the present invention, showing a dovetail joint tenon element 14*e* engaged with a dovetail joint recess, mortise element 12*e* interlocked and that are formed from a portion of the right shell 14 periphery and internal spaces for creating the dovetail interlocking joint tenon element 14*e* while the dovetail joint recess mortise element 12*e* is formed from left shell 12 periphery and internal milled elements on the interior surface of left shell 12. The specific dimensions of the dovetail tenons and interlocking recesses can be varied depending on different locations on each of the receiver shells.

Figure 13A:
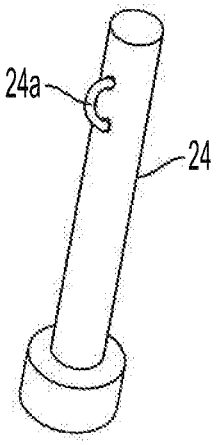
FIG. 13A shows a perspective view of a first takedown pin used in the present invention.

Referring now to FIG. 13A, a conventional first takedown pin 24 is shown that is used to fasten the left shell 12 of the receiver to the right shell 14 of the receiver at an appropriate location after the dovetail interlocking joints have been connected together forming the receiver 10. The first takedown pin 24 includes a movable spring activated locking tab 24*a*. The first takedown pin 24 fastens the left shell 12 to the right shell 14 to prevent potential vertical movement relatively between the left shell 12 and the right shell 14 to reinforce and thereby ensure receiver integrity. The first takedown pin 24 is manually positioned in aperture 28 in the left shell and in aperture 30 the right shell (FIG. 9) of the receiver to firmly fasten the left and right shells together. The first takedown pin 24 prevents vertical movement of the left shell 12 relative to the right shell 14 to prevent disengagement of the dovetail interlocking joints to firmly secure and hold the receiver left shell 12 and right shell 14 together.

Figure 13B:
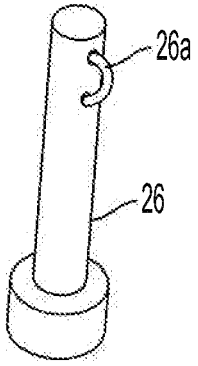
FIG. 13B shows a perspective view of a second takedown pin used in the present invention.

FIG. 13B shows a conventional second takedown pin 26 that is used in the invention in aperture 32 in the left shell (FIG. 9) and in aperture 34 in the right shell (FIG. 5) to secure the left receiver shell 12 to the right receiver shell 14 vertically. The second takedown pin 26 includes a movable spring-loaded tab 26*a* that helps secure and retain the second takedown pin 26 in position, once it is inserted and fastened to both the left shell 12 and right shell 14, securely holding them together.

The second takedown pin 26 also prevents vertical movement between the left shell 12 and the right shell 14 to prevent disengagement of the left and right shells, forming the receiver 10. The use of the first takedown pin 24 and the second takedown pin 26 also greatly enhances the integrity of the receiver 10 formed by the invention, without any welds or rivets, with just the dovetail interlocking joints and two takedown pins to firmly hold the receiver 10 together.

While the preferred embodiment of the machine-gun receiver has been described herein relating to a representative model of a known machine-gun, Applicants' receiver invention can be utilized and is intended to be utilized to produce numerous different types, calibers, and models of a lightweight machine gun, all of which can or may employ Applicants' invention utilizing the dovetail interlocking joints to interlock a left shell and a right shell body structure, as disclosed.

The invention claimed is:

1. A receiver for a lightweight machine-gun comprising:

a left shell having a substantially flat, elongated, single-piece milled metal body, with a substantially rectangular peripheral shape, a substantially flat, vertical, forward end face, a substantially flat, vertical, rear end face, said left shell having an outside receiver surface and an inside receiver surface, and a plurality of dovetail interlocking joints milled at strategic locations on the inside left shell receiver surface, facing perpendicularly inwardly, from its inside surface;

a right shell having a substantially flat, single-piece, milled metal body, with a substantially rectangular peripheral shape, a substantially flat, vertical, forward end face, a substantially flat, vertical, rear end face, said right shell having an outside receiver surface and an inside receiver surface, and a plurality of dovetail interlocking joints milled at strategic locations corresponding to said dovetail interlocking joints on said left shell and said right shell receiver surfaces, facing perpendicularly inwardly on its inside surface; said plurality of dovetail interlocking joints facing inwardly from its inside right shell surface and positioned relative to said dovetail joints facing inwardly from the left shell inside surface to correspondingly join the left shell and the right shell dovetail joints together, firmly interlocking the left shell and the right shell to form a machine-gun receiver;

said left shell inside receiver surface having a raised protrusion perpendicular to the left shell inside receiver surface and having a flat parallel end surface to said left shell receiver inside surface, said raised left shell inside receiver surface raised protrusion including an aperture from the left shell outside receiver surface through the left shell inside receiver surface and through the end surface of the raised protrusion, said raised protrusion aperture for receiving a takedown pin;

said right shell inside receiver surface having a raised protrusion perpendicular to the right shell inside receiver surface and having a flat parallel end surface to said right shell receiver inside surface, said raised right shell inside receiver surface raised protrusion including an aperture from the right shell outside receiver surface through the right shell inside receiver surface and through the end of the raised protrusion, said aperture for receiving a takedown pin; and, a take down pin connected to and through said right shell receiver outside surface and inside surface and said the left shell outside surface and inside surface for further joining said left shell to said right shell to prevent vertical movement between the left shell and the right shell, said takedown pin including a movable spring-activated locking tab.

2. A receiver for a lightweight machine-gun as in claim 1, including: said left shell body having at least one or more open passages disposed near said left shell end face forward end for air flow for dispensing heat from the forward end of said receiver; and said right shell body having at least one or more open passages disposed near said right shell end face forward end for air flow for dispensing heat from the forward end of said receiver.

3. A receiver for a lightweight machine-gun as in claim 1, including:

said left shell outside receiver surface and said right shell outside receiver surface of their single-piece metal bodies, each outside surface includes one or more recessed areas of a predetermined shape and location for reducing weight of the left shell body and the right shell body and a plurality of left shell and right shell outside surface ridges having greater thickness than said recessed areas for strengthening said left shell body and said right shell body, thereby strengthening said receiver.

4. The method of manufacturing a receiver for use in constructing a lightweight machine-gun comprising the steps of:

a) machining a left shell by milling a single piece of metal to include a predefined substantially elongated, rectangular peripheral shape, a receiver outside surface, a receiver inside surface, a forward, substantially flat, vertical end face, and a rear, substantially flat, vertical, end face, and a plurality of dovetail interlocking joints milled on said left shell receiver inside surface projecting perpendicularly outwardly from the left shell inside surface;

b) machining a right shell by milling a single piece of metal to include a predefined substantially elongated, rectangular peripheral shape, a receiver outside surface, a receiver inside surface, a forward substantially flat end face, and a substantially flat rear end face, and a plurality of dovetail joints milled on said right shell inside surface, projecting substantially perpendicularly outwardly from the right shell inside surface, said right shell dovetail interlocking joints located in strategic corresponding areas that correspond to the dovetail interlocking joints on said left shell in size and shape and location, said right shell dovetail interlocking joints and said left shell dovetail interlocking joints being aligned between the left shell inside surface and the right shell inside surface for the interlocking of the dovetail joints; and c) connecting said left shell dovetail interlocking joints to said right shell dovetail interlocking joints forming a machine-gun receiver comprising compartment with a front forward open-end for receiving the gun barrel assembly and a gas tube assembly and a rear end for introduction of the operating rod assembly and for connecting to a buttstock;

d) machining a raised protrusion on the right shell interior surface and on the left shell interior surface at locations on the right shell and locations on the left shell, the right shell raised protrusion engaging the left shell raised protrusion face-to-face, when the left shell and right shell are joined together;

e) drilling a takedown pin aperture in the left shell receiver exterior and the interior surface raised protrusion and in and aligned with the right shell receiver exterior and interior surface raised protrusion, at a drill aperture location for alignment of a left shell takedown pin aperture with a right shell takedown pin aperture when the left shell is connected to the right shell with the dovetail interlocking joints forming a machine gun receiver, and f) inserting a takedown pin into the right shell and left shell machine gun receiver predrilled takedown pin aperture in said left shell receiver interior surface raised protrusion and said right shell receiver interior surface raised protrusion for preventing vertical movement of said left shell with respect to said right shell in the formed machine gun receiver during firing.

5. The method of manufacturing a receiver for the construction of a lightweight machine-gun as in claim 4, comprising the additional steps of:

milling the left shell receiver inside surface to include a left shell portion of a gun threaded barrel assembly housing female receptor that includes a plurality of dovetail interlocking joints; and milling the right shell receiver inside surface to include the right shell portion of a threaded gun barrel assembly housing female receptor that includes a plurality of dovetail interlocking joints strategically positioned to correspond and engage the left shell portion of a threaded gun barrel assembly housing locking receptor plurality of dovetail interlocking joints.

6. The method of manufacturing a receiver for the construction of a lightweight machine-gun as in claim 4 comprising the additional steps of:

milling the left shell receiver inside surface to include a left shell portion of a gas tube assembly housing that includes a plurality of dovetail interlocking joints; and milling the right shell receiver inside surface includes the right shell portion of a gas tube assembly housing that includes a plurality of dovetail interlocking joints strategically positioned correspond engage the left shell portion of a gas tube assembly housing a plurality of dovetail interlocking joints.

7. The method of manufacturing a receiver for the construction of a lightweight machine-gun as in claim 4 comprising the additional steps of:

milling the left shell receiver inside surface along a bottom peripheral rear area horizontally to form a plurality of dovetail interlocking joints; and milling the right shell receiver inside surface along a bottom peripheral rear area horizontally to form a plurality of dovetail interlocking joints strategically positioned to correspond and engage the left shell receiver inside surface bottom peripheral rear area horizontally form a plurality of dovetail interlocking joints.

8. The method of manufacturing a receiver for the construction of a lightweight machine-gun as in claim 4 comprising the additional steps of:

milling a substantially horizontal rail along the periphery of said left shell rear area that includes a plurality of dovetail interlocking joints facing inwardly; and milling a substantially horizontal rail along the periphery of said right shell rear area that includes a plurality of dovetail interlocking joints facing inwardly and positioned correspondingly to the milled horizontal rail peripheral plurality of dovetail interlocking joints, whereby the left shell peripheral rail dovetail interlocking joints can be engaged with said right shell upper peripheral rail dovetail interlocking joints interlocking said left receiver shell to said right receiver shell.

9. A receiver for a lightweight machine-gun comprising:

a left shell having a plurality of dovetail interlocking joints spaced-apart along predetermined sections including peripheral areas, top and bottom edges inwardly;

a right shell sized and shaped to interlock together with said left shell to form the receiver of a machine-gun, said right shell having a plurality of dovetail interlocking joints faced apart along predetermined sections including peripheral areas, top and bottom edges inwardly, said left shell and said right shell having substantially corresponding peripheral shapes and sized with corresponding and correlated dovetail interlocking joints, said right shell joined to said left shell by said dovetail interlocking joints forming a lightweight machine-gun receiver;

said left shell and said right shell, each having and exterior surface and an interior surface that includes a raised perpendicular protrusion with a central aperture from said right shell and said left shell exterior surface to said right shell and said left shell interior surface; and a take down pin connected to said receiver and through said right shell and said left shell raised protrusions for further joining said left shell to said right shell to prevent vertical movement between the left shell and the right shell.

10. A receiver as in claim 9 including: said left shell having a single piece body milled from a single piece of metal including flat planar sections and reinforcing ribs thicker than said planar sections and said left shell body including a plurality of open passages in the forward end of said left shell for air flow for heat ventilation for the forward section of a machine-gun and for receiving and securing a threaded barrel assembly.

11. A receiver for a lightweight machine-gun as in claim 5, including:

said right shell and said left shell joined together by said plurality of dovetail interlocking joints for firmly interlocking said left shell to said right shell, forming a compartment capable of housing and connecting a machine-gun barrel assembly and gas tube operating assembly, guiding a bolt and operating rod assembly, and connecting a trigger mechanism and a butt stock removably attachable at one end of said receiver; and a rear gunsite mounted to the top rear areas of said right shell and said left shell joined together.

* * * * *